US006050867A

United States Patent [19]

Shields et al.

[11] Patent Number: 6,050,867

[45] Date of Patent: Apr. 18, 2000

[54] DRAIN SYSTEM FOR MARINE VESSEL

[75] Inventors: Waylon D. Shields; Woody R. Smith; Tommy R. Yerby, all of Stillwater, Okla.

[73] Assignee: Brunswick Corporation, Lake Forest, Ill.

[21] Appl. No.: 09/293,629

[22] Filed: Apr. 16, 1999

[51] Int. Cl.[7] ..... B63H 21/00; B63B 13/00

[52] U.S. Cl. ..... 440/88; 114/183 R; 114/197

[58] Field of Search ..... 440/88; 114/173, 114/174, 183 R, 184, 197, 198

[56] References Cited

U.S. PATENT DOCUMENTS

| | | | |
|---|---|---|---|
| 1,304,961 | 5/1919 | Good | 440/89 |
| 4,019,454 | 4/1977 | Landwerlen | 114/197 |
| 4,693,690 | 9/1987 | Henderson | 440/88 |
| 4,875,884 | 10/1989 | Meisenburg | 440/88 |
| 5,047,753 | 9/1991 | Birchfield | 340/686 |
| 5,048,556 | 9/1991 | Grumelot et al. | 137/270 |
| 5,334,063 | 8/1994 | Inoue et al. | 440/88 |
| 5,460,111 | 10/1995 | Frahn | 114/197 |
| 5,579,727 | 12/1996 | Logan et al. | 123/41.14 |
| 5,628,285 | 5/1997 | Logan et al. | 123/41.14 |

*Primary Examiner*—Russell D. Stormer
*Assistant Examiner*—Patrick Craig Muldoon
*Attorney, Agent, or Firm*—William D. Lanyi

[57] ABSTRACT

A drain system is provided for a marine vessel in which three types of drain operations can be performed at one common location near the transom of the marine vessel. A multiple conduit structure is provided with a plurality of fluid passages extending at least partially through its structure. A first fluid passage allows the bilge of the boat to be drained. A second fluid passage allows multiple locations on the engine to be drained through a common port. A second sealing plug is provided to close the second passageway that prevents fluid communication between the various fluid conduits used to drain the cooling water of the engine. A third fluid passage is provided through the multiple conduit structure to allow lubricating oil to be drained from the engine. A single hole through the transom of a boat is all that is required to allow the multiple conduit structure to be attached to the boat and extend through the transom for the purpose of draining the bilge, the engine cooling water, and the engine lubricating fluid.

19 Claims, 4 Drawing Sheets

DRAIN SYSTEM FOR MARINE VESSEL

BACKGROUND OF THE INVENTION

1. Field of the Invention

The present invention is generally related to a drain system for a marine vessel and, more particularly, to a drain system that allows easy access at the transom of a marine vessel to drain plugs for the bilge drain, the cooling water drain, and an oil drain.

2. Description of the Prior Art

Many types of marine vessels incorporate a drain hole formed through the transom of the boat to allow bilge water to be drained from the marine vessel. In a typical application, a boat is first removed from the water and then placed on a boat trailer or stand. Then the drain plug is removed from an opening extending is through the transom of the boat to allow bilge water to drain from the boat.

As will be described below, it is known to provide an oil drain conduit that extends through an opening in the transom to drain lubricating oil from an engine of the marine engine. It is also known that several different cooling water regions of an engine can be connected together with a common drain valve assembly for automatically draining water from the cooling system when the ambient temperature drops below a preselected magnitude.

U.S. Pat. No. 4,875,884, which issued to Meisenburg on Oct. 24, 1989, discloses a marine propulsion device with a thru-transom engine oil drain system. A fluid flow tube is provided which extends from the lower portion of the engine oil pan to a point on the boat transom below the pan. The upper end portion of the tube is connected through a control valve which communicates with the pan interior. The lower or discharge tube end portion is connected through a fitting which extends through the transom. A removable plug is associated with the fitting and, when removed, permits oil to drain out through the transom and into an oil collection receptacle when the control valve is opened.

U.S. Pat. No. 4,019,454, which issued to Landerlen on Apr. 26, 1977, discloses a boat plug apparatus. The boat plug apparatus is described as comprising a boat having a circular drain hole in the exterior of the transom and a ball which is pivotally attached to the transom exterior on both sides of the drain hole. The ball is positioned to be partially contained within the drain hole when acted upon by gravity. When the drain hole is not otherwise sealed the exterior water portion forces the ball into the hole and causes the ball to sealingly close the hole, preventing the water from entering the boat. When the boat is moving or is raised out of the water, the ball is free to swing away from the drain hole and water within the boat escapes through the drain hole.

U.S. Pat. No. 5,048,556, which issued to Grumelot et al on Sep. 17, 1991, discloses a transom mounted valve with a remote actuator. The valve includes a valve sleeve which is disposed in the drain port of a boat transom and carries a valve stem for axial movement. The valve stem includes a valve head movable with the stem between an open position and a closed position. A cap is releasably secured on the inboard end of the sleeve and mounts an actuating cable guide and anchor, as well as a cam pivotally carried by the cap and attachable to the movable portion of the actuating cable. The cam engages the valve stem. Upon rotation of the cam by linear movement of the actuator cable, the stem is moved against the bias of the spring from the closed position to the open position with the spring bias closing the valve when the cam is moved to the close position.

U.S. Pat. No. 5,628,285, which issued to Logan et al on May 13, 1997, discloses a drain valve for a marine engine. The drain valve assembly automatically drains water from a cooling system of an inboard marine engine when the ambient temperature drops to a preselected value. The drain valve includes a cup-shaped base having a group of inlets connected to portions of a cooling system of the engine to be drained. The open end of the base is enclosed by a cover. Each inlet defines a valve seat and a sealing piston is mounted for movement in the base and includes a series of valve members that are adapted to engage the valve seats. An outlet is provided in the sidewall of the cup-shaped base. The valve members on the sealing piston are biased to a closed position by a coil spring and the temperature responsive element interconnects the sealing piston with the cover. The temperature responsive element is characterized by the ability to exert a force in excess of the spring force of the coil spring when the ambient temperature is above about 50° F. to thereby maintain the valve members in the closed position. When the temperature falls below the selected temperature, the temperature responsive element retracts and thereby permits the valve members to be opened under the influence of the spring to automatically drain water from the cooling system of the engine.

U.S. Pat. No. 5,047,753, which issued to Birchfield on Sep. 10, 1991, described a drain plug position indicator apparatus. The apparatus includes a plug detector mechanism that is mounted adjacent an interior surface of a drain plug aperture directly through a transom of a boat. The detecting means includes a spring-biased switch positionable from an extended position in the absence of a plug to a retracted position in the presence of a plug directly through the transom. The switch is cooperative with an audible member to effect alarm in the absence of the plug.

U.S. Pat. No. 5,460,111, which issued to Frahn on Oct. 24, 1995, discloses a boat transom drain hole plug. The boat plug is used to seal the hole in a boat's transom. It provides a flexible rubber stopper having an axial channel that is insertable into the transom hole. A plug bolt and a plug nut are threadedly engaged inside the rubber stopper. A spring rod, attached to the plug bolt, may be rotated by hand to turn the plug bolt on the plug nut's threads. Clockwise rotation shortens the length of the rubber stopper and expands its diameter to make a water tight seal. Counterclockwise rotation causes the rubber stopper to relax, allowing it to be easily inserted or removed from the transom hole. The flexibility of the spring rod allows the user to apply torque while keeping his hand a safe distance from the hull of the boat, thereby avoiding scraped knuckles.

U.S. Pat. No. 4,693,690, which issued to Henderson on Sep. 15, 1987, discloses a quick drain assembly for a boat engine. The device is used for an inboard boat engine, especially an engine of the type having a water jacket. A plurality of drain cocks are provided and the engine coolant must drain through them after each use of the engine. The quick drain device is in the form of a barrel having a plurality of lateral tubes radiating therefrom. An expandable stopper is received within the barrel and covers the ends of the tubes and thereby prevents flow therethrough. The other ends of the lateral tubes are connected to the drain cocks or drain plugs located on the engine block. Removal of the expandable stopper simultaneously drains all the drain plugs.

U.S. Pat. No. 5,579,727, which issued to Logan et al on Dec. 3, 1996, discloses a separating apparatus for the cooling system of a marine engine. The apparatus is intended for separating solid material from cooling water in the cooling system of a marine engine. The apparatus includes a hollow member or housing having an inlet to receive cooling water and having an outlet. A drain opening is located in the housing above the bottom surface of the housing and is connected through a suitable conduit to a temperature responsive drain valve. A generally J-shaped tubular member is disposed in the housing and has one end connected to the drain outlet while a second end is slightly above the bottom surface of the housing, out of alignment with the inlet. When the drain valve is opened, water will drain through the housing to the drain outlet while solid debris will collect in the bottom of the housing beneath the second end of the tubular member.

U.S. Pat. No. 5,334,063, which issued to Inoue et al on Aug. 2, 1994, describes a cooling system for a marine propulsion engine. It describes a number of embodiments of cooling systems for marine propulsion units having water cooled internal combustion engines in which the cooling jacket of the engine is at least partially positioned below the level of the water in which the watercraft is operating. The described embodiments all permit drainage of the engine cooling jacket when it is not being run. In some embodiments, the drain valve also controls the communication of the coolant from the body of water in which the watercraft is operating with the engine cooling jacket. Various types of pumping arrangements are disclosed for pumping the bilge and automatic valve operation.

The patents described above are hereby explicitly incorporated by reference herein.

Although various types of drains have been used to permit fluids to pass through the transom, there remains a need to improve the convenience for a boat operator to perform various simple maintenance tasks, such as draining the bilge of the boat, draining the cooling water from the engine of a marine propulsion system, and draining the lubricating oil from the engine. It would therefore be significantly beneficial if a simplified system could be provided to allow a boat operator to perform these three tasks with a common device that does not require the boat operator to manipulate components on the engine or within the hull of the boat. It would also be beneficial if boat manufacturers could accomplish these goals without creating multiple holes through the transom of the boat.

SUMMARY OF THE INVENTION

A drain system for a marine vessel made in accordance with the preferred embodiment of the present invention comprises a multiple conduit structure that is shaped to be received through a single opening formed in a transom of the marine vessel. The multiple conduit structure has an inboard end extending in a direction forward of the transom and an outboard end extending in a direction rearward of the transom. It also has a first fluid passage formed through the body of the multiple conduit structure between the inboard and outboard ends. A first sealing plug is shaped to be received in the first fluid passage in order to prevent a fluid from passing therethrough from the inboard end to the outboard end.

A second fluid passage is formed at least partially through the body of the multiple conduit structure between the inboard and outboard ends and a second sealing plug is shaped to be received in the second fluid passage to prevent a fluid from passing therethrough.

In a particularly preferred embodiment of the present invention, the first fluid passage connects a bilge region of the marine vessel in fluid communication with a region rearward of the transom and the first sealing plug is attachable in threaded relation with the first fluid passage at the outboard end of the multiple conduit structure.

A plurality of fluid conduits can be provided which extend into the multiple conduit structure and are in fluid communication with the second fluid passage. The second sealing plug can be insertable into the second fluid passage in a way that inhibits flow through the second fluid passage while also preventing fluid communication between selected ones of the plurality of fluid conduits that extend into the multiple conduit structure and are in fluid communication with the second fluid passage. Each of the plurality of fluid conduits can be connected in fluid communication with cooling water reservoirs of an internal combustion engine.

In a particularly preferred embodiment of the present invention the drain system further comprises a third fluid passage formed to the body of the multiple conduit structure between the inboard and outboard ends. It also comprises a third sealing plug shaped to be received in the third fluid passage to prevent a fluid from passing therethrough. The third fluid passage can be connected in fluid communication with an oil reservoir of an internal combustion engine.

The first, second, and third fluid passages provide conduits through which the bilge water, cooling water, and lubricating oil can be drained from a marine vessel at one convenient location through the transom of the boat.

BRIEF DESCRIPTION OF THE DRAWINGS

The present invention will be more fully and completely understood from a reading of the description of the preferred embodiment in conjunction with the drawings in which.

DESCRIPTION OF THE PREFERRED EMBODIMENT

Figure 1:
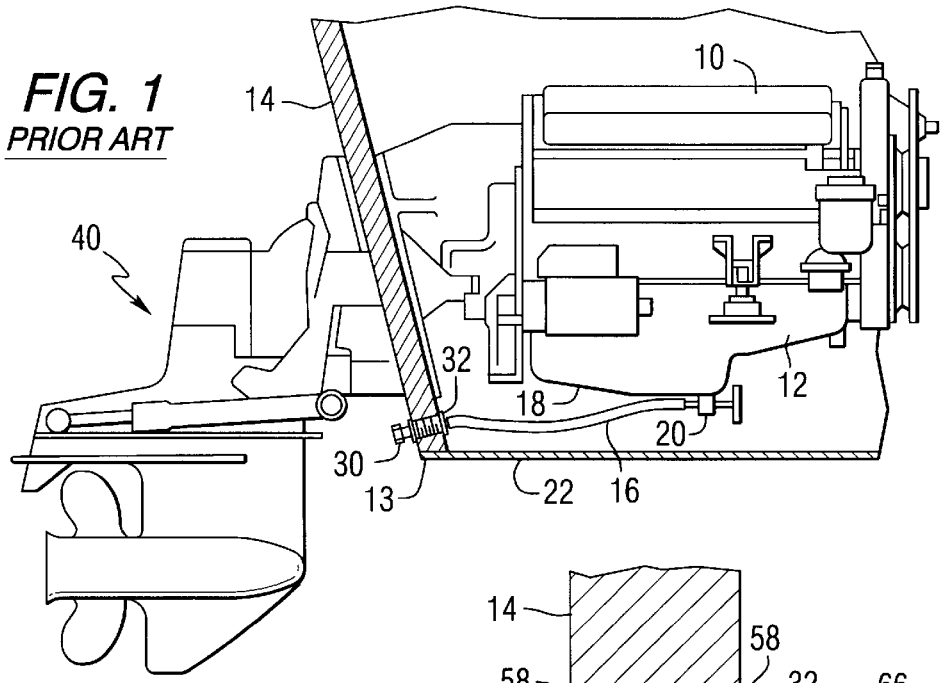
FIG. 1 PRIOR ART
FIGS. 1 and 2 show various prior art means for providing a drain system for a boat.

Throughout the description of the preferred embodiment, like components will be identified by like reference numerals.

FIG. 1 shows a known system by which an internal combustion engine 10 with an oil pan 12 can be drained through the transom 14. A fluid flow tube 16 is connected to the bottom 18 of the oil pan 12 through a control valve 20. As described in the U.S. Pat. No. 4,875,884, the boat 13 has a floor 22 attached to the transom 14. A removable plug 30 is used in conjunction with a fitting 32 to seal the end of the tube 16. The lubricating oil of the engine 10, which is located within the structure of the boat 13, can be drained through the transom 14 by opening the control valve 20 and removing the plug 30 to allow the lubricating fluid to pass through the fitting 32. FIG. 1 also shows a stern drive unit 40 attached to the transom 14. The operation of the system shown in FIG. 1 is described in detail in U.S. Pat. No. 4,875,884.

Figure 2:
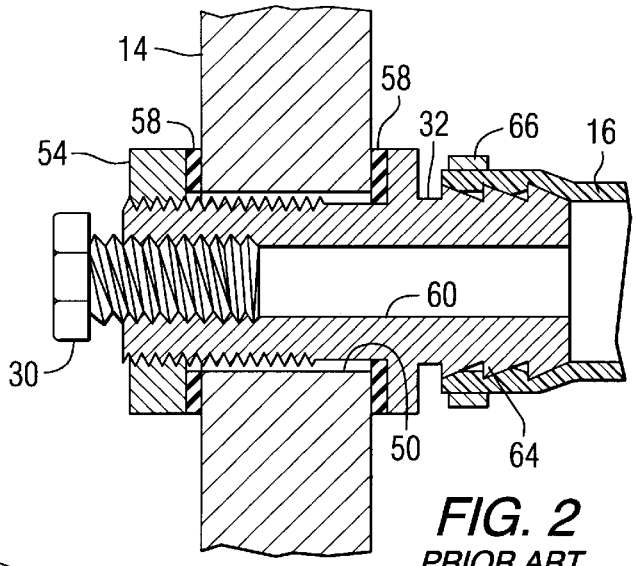
FIG. 2 PRIOR ART

FIG. 2 is an enlarged view of the mechanism shown in FIG. 1 and used to extend through a hole 50 in the transom 14. The fitting 32 extends through the hole 50 and is attached to the transom by a nut 54. Two annular sealing rings 58 are used to prevent leakage through the hole 50. The hose 16 is attached in fluid communication with the passage 60 by disposing the hose 16 on the barbs 64 of the fitting 32. A hose clamp 66 can be used for these purposes. The plug 30 seals the end of the passage 60. FIG. 2 is described in more significant detail in U.S. Pat. No. 4,875,884.

Figure 3:
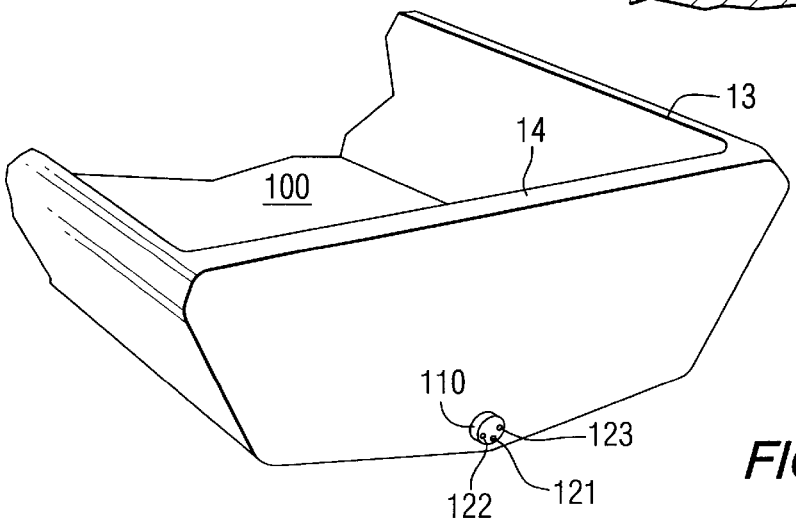
FIG. 3 shows the transom of a boat with an outboard end of the present invention extending therefrom.
Figure 4:
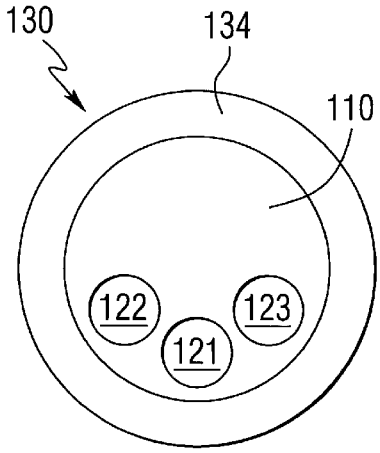
FIG. 4 is an end view of the outboard end of a multiple conduit structure used in a preferred embodiment of the present invention.

FIG. 3 is a simplified illustration of a boat 13 having a transom 14. Within the bottom portion of the boat 13, a bilge 100 is defined as the region proximate the bottom surface of the internal portion of the boat 13. Also shown in FIG. 3 is the outboard end of a multiple conduit structure 110 and the outboard ends of three fluid passages, 121, 122, and 123. In a preferred embodiment of the present invention, these three fluid passages can be used to drain bilge water, cooling water, and lubricating oil from both the boat and the internal combustion engine used as its propulsion system. The outboard end 110 of the multiple conduit structure 130 is illustrated in FIG. 4. The first, second, and third fluid passages are identified by reference numerals 121, 122, and 123. A flange 134 is also provided in the embodiment of the present invention shown in FIG. 4. Although the three fluid passages are illustrated as being clustered near the bottom portion of the outboard end 110 in FIG. 4, it should be understood that other locations of the fluid passages are also within the scope of the present invention. In addition, if only two fluid passages are provided through the multiple conduit structure, the positions of those fluid passages relative to the outboard end 110 of the multiple conduit structure 10 could be positioned differently than shown in FIG. 4.

Figure 5:
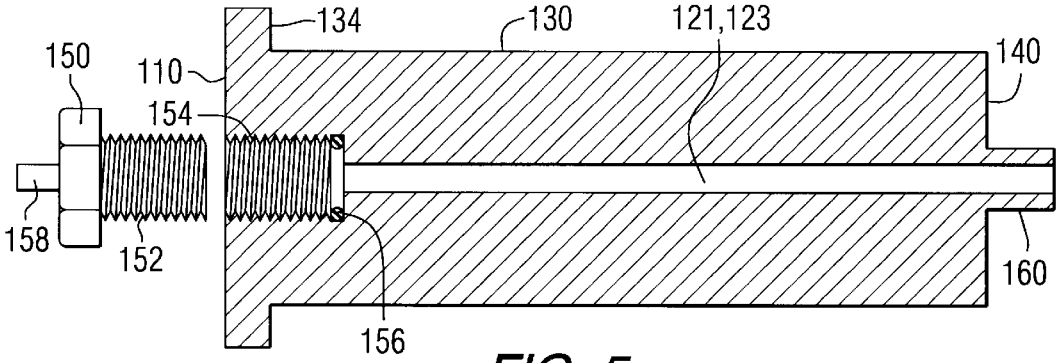
FIG. 5 is a section view of a multiple conduit structure showing first or third fluid passages extending therethrough.

FIG. 5 is a sectional view of a multiple conduit structure 130 having an outboard end 110 and an inboard end 140. The first fluid passage 121 is formed through the body of a multiple conduit structure 130 between the inboard 140 and outboard 110 ends. The flange 134 is provided at the outboard end of the multiple conduit structure 130 to facilitate its attachment to a transom of a boat. The flange 134 can operate similarly to the head of a bolt and the generally cylindrical body of the multiple conduit structure 130 can be threaded to allow a nut to cooperate with the flange 134 so that the multiple conduit structure can be attached to a transom in a manner generally similar to that illustrated in FIG. 2 and described above. It should be understood that the precise means by which the multiple conduit structure 130 is attached to the transom is not critical to the operation of the present invention. A first sealing plug 150 is provided with threads 152 so that it can be threaded into mating threads 154 formed in the multiple conduit structure 130 at the outboard end 110 of the first fluid passage 121. An O-ring 156 can also be provided to aid in the sealing of the first fluid passage 121 when the plug 150 is received in threaded portion of its outboard end 110. An extension 158 can be provided to simplify the insertion of the plug 150. Alternatively, the head of the plug can be shaped in a hexagonal form to allow a wrench to be used for these purposes. At the inboard end 140 of the first fluid passage 121 shown in FIG. 5, a nipple extension 160 is also provided. Depending on the intended application of the present invention, the nipple extension 160 can be used to attach a drain hose from an area within the boat structure that is intended to be drained. For example, although the nipple extension 160 is not necessary when the first fluid passage is used as a bilge drain, the configuration shown in FIG. 5 can also be used to provide the third fluid passage 123 which can be used to drain lubricating oil from the engine of the marine propulsion system. In that case, a hose can be attached to the nipple extension 160 in a manner generally similar to that described in U.S. Pat. No. 4,875,884.

Figure 6:
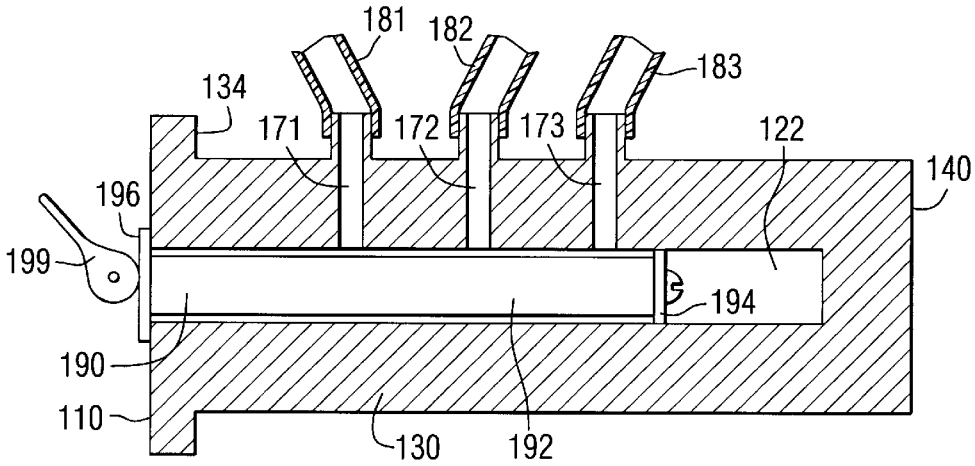
FIGS. 6 and 7 show two embodiments of a second fluid passage and a second sealing plug.

FIG. 6 is another section view of the multiple conduit structure 130 showing the second fluid passage 122 which is formed in the multiple conduit structure and extends at least partially through the body of the multiple conduit structure between the inboard end 140 and the outboard end 110. As can be seen in FIG. 6, the second fluid passage 122 does not extend entirely through the multiple conduit structure 130. A plurality of fluid conduits, 171, 172, and 173 extend through the multiple conduit structure 130 and are in fluid communication with the second fluid passage 122. Each one of the plurality of fluid conduits, 171–173, can be attached to a hose in order to drain cooling water from various locations of the engine. These hoses are identified by reference numerals 181, 182, and 183.

It is important to note that the hoses, 181–183, should not be connected in direct fluid communication with each other during the operation of the marine propulsion system in many applications of internal combustion engines to marine propulsion systems. In typical applications, the locations on the engine where the hoses, 181–183, are connected are at different pressure magnitudes. The differential pressure between these hose locations can cause water to flow directly from one of the hoses to another one of the hoses if they are in direct fluid communication with each other when the engine is operated. For that reason, the hoses, 181–183, can not be directly connected to a common manifold in most applications. As a solution to this restriction, the second sealing plug 190 is configured to prevent fluid communication between the individual ones of the plurality of fluid conduits, 171–173, simultaneously with preventing flow through the second fluid passage 122. In a particular embodiment illustrated in FIG. 6, the second sealing plug 190 comprises a flexible portion 192 which can expand radially when the two axial ends, 194 and 196, are drawn toward each other. In other words, when axial end 194 is drawn toward axial end 196, the effective diameter of the flexible portion 192 is caused to expand outward from a centerline extending between the two axial ends. This outward expansion blocks the radially inward ends of the plurality of conduits 171–173, and prevents fluid from flowing from the hoses, 181–183, into the second fluid passage 122 and in fluid communication with the other conduits and other hoses. The type of sealing plug used for these purposes is generally similar in operation to the well known plug used in vacuum storage bottles. The operation of the plug 190 responds to the rotation of a handle 199 which draws the two axial ends, 194 and 196, together to expand the flexible portion 192.

Figure 7:
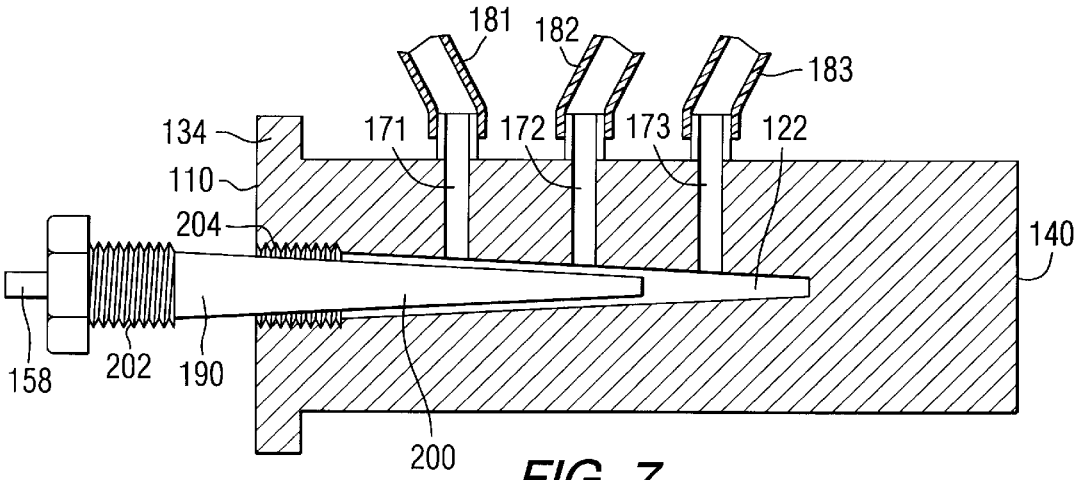

FIG. 7 shows an alternative embodiment of the present invention in which the second fluid passage 122 is tapered. As in the embodiment described above in conjunction with FIG. 6, the embodiment illustrated in FIG. 7 comprises a plurality of conduits, 171–173, which are attached to a plurality of hoses, 181–183, in a manner generally similar to that described above. However, instead of using a second sealing plug 190 which expands in reaction to the movement of its axial ends, 194 and 196, to seal the plurality of fluid conduits, the embodiment illustrated in FIG. 7 uses the tapered shape of the second fluid passage 122 in cooperation with the tapered portion 200 of the second sealing plug 190.

When the second sealing plug 190 is threaded into the second fluid passage, the tapered portion 200 moves into tight contact with the internal tapered surface of the second fluid passage 122 to block the plurality of fluid conduits, 171–173, and prevent fluid communication between them. When the threaded portion 202 of the second sealing plug 190 is threaded into the threaded portion 204 of the second fluid passage 122, the two tapered portions are drawn tight against each other to perform the sealing function. It should be understood that FIGS. 6 and 7 only show two of the many acceptable embodiments of the second sealing plug. These two embodiments work in slightly different ways to perform similar functions. The intended function of the second sealing plug 190 is to block the ends of the plurality of conduits, 171–173, and also to prevent the flow of fluid out of the second fluid passage 122. In both examples, the second fluid passage 122 does not extend through the inboard end 140 of the multiple conduit structure 130. However, it should be understood that one of the plurality of conduits could be provided at the axially inboard end of the second fluid passage 122 if that configuration is desirable.

Figure 8:
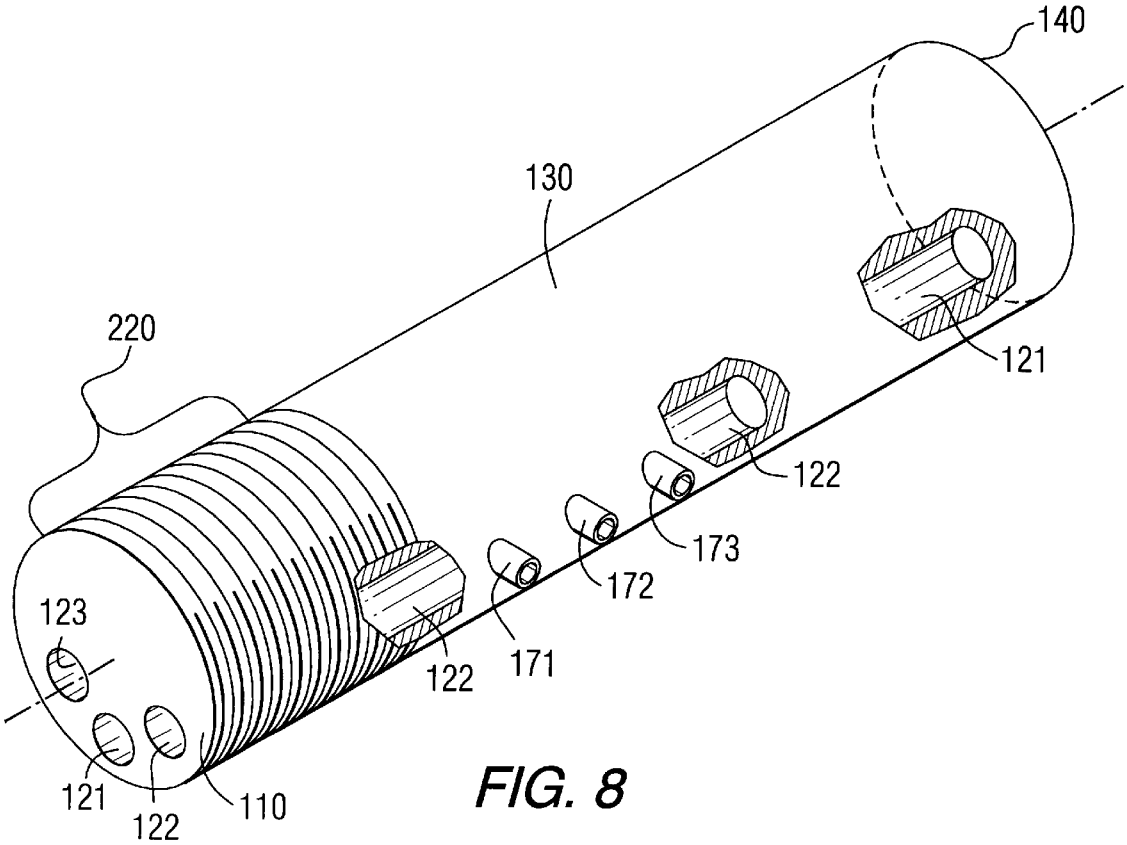
FIG. 8 shows an isometric view of an alternative embodiment of the present invention.

FIG. 8 shows an isometric view of an alternative embodiment of the present invention. The embodiment shown in FIG. 8 does not have a flange 134. Instead, a portion 220 of the outer cylindrical surface of the multiple conduit structure 130 is provided with threads that allow two nuts to be used to attach the multiple conduit structure 130 to the transom after the multiple conduit structure is inserted through a hole formed in the transom. The multiple conduit structure 130 has been partially sectioned to expose the first 121 and second 122 fluid passages. In can also be seen in FIG. 8 that the specific relative positions of the first 121, second 122, and third 123 fluid passages are not limited to the positions illustrated in FIG. 4 and described above.

With continued reference to FIG. 8, the plurality of conduits, 171–173, are shown extending into the body of the multiple conduit structure 130 to provide fluid communication with the second fluid passage 122. The first fluid passage 121 is shown extending all the way through the length of the multiple conduit structure 130 and through its inboard end 140. This is also true for the third fluid passage 123, although not shown in FIG. 8. The inboard end 140 of the third fluid passage 123 would be typically be provided with a nipple extension 160 such as that described above in conjunction with FIG. 5. The nipple extension 160 facilitates the connection between the third fluid passage and an oil drain of the engine.

Figure 9:
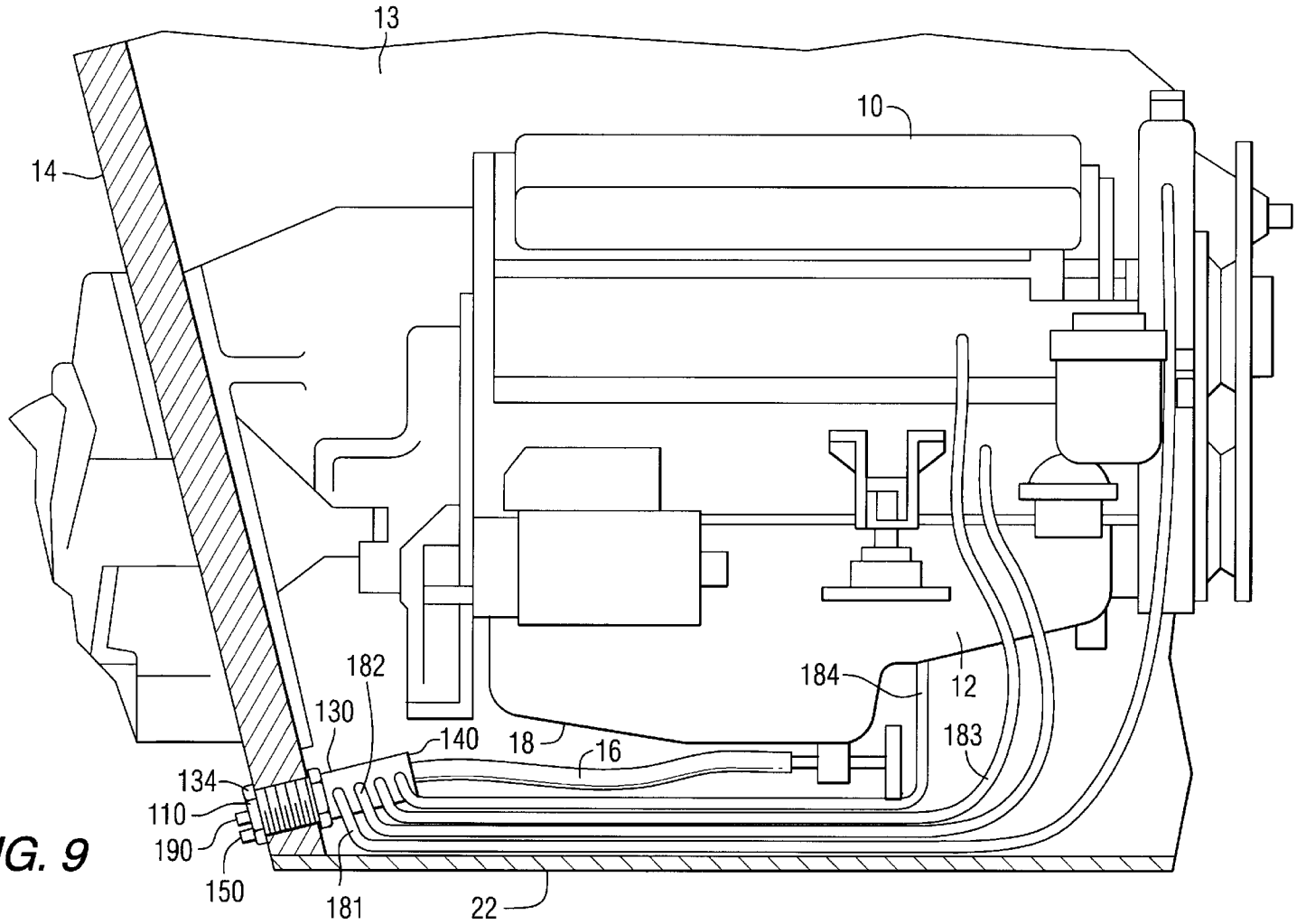
FIG. 9 shows a boat with an engine associated with a preferred embodiment of the present invention.

FIG. 9 shows the preferred embodiment of the present invention installed in a boat 13 and attached to a bottom portion of the transom 14. As can be seen, the inboard end 140 of the multiple drain structure 130 extends into the bilge portion of the boat. An oil hose 16 connects the nipple extension 160 (not shown in FIG. 9) of the third fluid passage 123 with an opening in the lower portion 18 of the oil pan 12. This allows the lubricating fluid of the engine to be drained through the hose 16 and through the third fluid passage 123 when the third sealing plug is removed from the outboard end of the third fluid passage. The third sealing plug is similar in structure and operation to the first sealing plug 150 described above. FIG. 9 also shows a plurality of hoses, 181–184, extending from a plurality of conduits similar to those identified by reference numerals 171–173 in conjunction with FIGS. 6 and 7. Although not specifically shown in FIG. 9, it should be understood that the bilge of the boat 13 is drained through the inboard end 140 of the first fluid passage 121 when the first sealing plug 150 is removed. If the water in the bilge rises to a sufficient height relative to the inboard end 140 of the multiple conduit structure 130, water can be drained from the boat by removing the first plug 150 from the outboard end of the first fluid passage 121.

With continued reference to FIG. 9, it should be understood that the four hoses, 181–184, are connected to preselected locations of the engine 10 where it is known that cooling water can be trapped in reservoirs when the engine is not operating. To drain all of the water from the engine 10, it is sometimes necessary to provide multiple hoses so that all of the trapped cooling water can be removed from the engine. The number of hoses, 181–184, needed for any particular engine is strictly a function of the engine design and configuration of its internal cooling passages. In some engines, the passageways proximate the exhaust ports must be separately drained. However, regardless of the structure of the cooling system of the engine, the multiple hoses required to completely drain the engine can be attached to individual ones of the plurality of fluid conduits described above. The necessity for draining all of the water from an engine arises in situations where the ambient temperature is expected to fall below a magnitude that could cause the stored water within the engine to freeze and cause damage to the engine block.

From the above descriptions of the preferred embodiment of the present invention, it can be seen that the present invention provides a convenient and effective way of allowing a boat operator to drain the water from the bilge portion of the boat 13, to drain the cooling water from various cooling water reservoirs within the engine 10, and also to drain the lubricating oil from the oil pan 12. All of these procedures can be simply and easily accomplished by the boat operator at a common location at the rearward surface of the transom 14. The present invention therefore provides a solution to three problems which periodically confront boat operators.

An additional advantage of the present invention is that it simplifies the installation of three different draining systems. It allows all of these draining systems to be accomplished while only requiring a single opening to be formed through the transom 14. This significantly simplifies the effort for boat manufacturers to provide their boats with three different draining systems at one common location. Rather than requiring three individual holes through the transom 14, the present invention only requires a single hole. This vastly simplifies and reduces the cost incurred by boat manufacturers during the initial installation of the engine and its related drain systems. In addition, all of the drains can be accessed at one convenient location at the rear portion of the boat 13.

Although the present invention has been described with particular detail and illustrated to show one preferred embodiment of the present invention, it should be understood that other embodiments are also within its scope.

I claim:

1. A drain system for a marine vessel, comprising:

a multiple conduit structure shaped to be received through an opening formed in a transom of said marine vessel, said multiple conduit structure having an inboard end extending in a direction forward of said transom and an outboard end extending in a direction rearward of said transom;

a first fluid passage formed through the body of said multiple conduit structure between said inboard and outboard ends;

a first sealing plug shaped to be received in said first fluid passage to prevent a fluid from passing therethrough;

a second fluid passage formed at least partially through the body of said multiple conduit structure between said inboard and outboard ends; and a second sealing plug shaped to be received in said second fluid passage to prevent a fluid from passing therethrough.

2. The drain system of claim 1, wherein:

said first fluid passage connects a bilge region of said marine vessel in fluid communication with a region rearward of said transom.

3. The drain system of claim 2, wherein:

said first sealing plug is attachable in threaded relation with said first fluid passage at said outboard end of said multiple conduit structure.

4. The drain system of claim 1, further comprising:

a plurality of fluid conduits extending into said multiple conduit structure and in fluid communication with said second fluid passage.

5. The drain system of claim 4, wherein:

said second sealing plug is insertable into said second fluid passage to inhibit flow through said second fluid passage and to prevent fluid communication between selected ones of said plurality of fluid conduits.

6. The drain system of claim 4, wherein:

each of said plurality of fluid conduits is connected in fluid communication with a cooling water reservoir of an internal combustion engine.

7. The drain system of claim 1, further comprising:

a third fluid passage formed through the body of said multiple conduit structure between said inboard and outboard ends; and a third sealing plug shaped to be received in said first fluid passage to prevent a fluid from passing therethrough.

8. The drain system of claim 7, wherein:

said third fluid passage is connected in fluid communication with an oil reservoir of an internal combustion engine.

9. A drain system for a marine vessel, comprising:

a multiple conduit structure shaped to be received through an opening formed in a transom of said marine vessel, said multiple conduit structure having an inboard end extending in a direction forward of said transom and an outboard end extending in a direction rearward of said transom;

a first fluid passage formed through the body of said multiple conduit structure between said inboard and outboard ends, said first fluid passage connecting a bilge region of said marine vessel in fluid communication with a region rearward of said transom;

a first sealing plug shaped to be received in said first fluid passage to prevent a fluid from passing therethrough, said first sealing plug being attachable in threaded relation with said first fluid passage at said outboard end of said multiple conduit structure;

a second fluid passage formed at least partially through the body of said multiple conduit structure between said inboard and outboard ends; and a second sealing plug shaped to be received in said second fluid passage to prevent a fluid from passing therethrough.

10. The drain system of claim 9, further comprising:

a plurality of fluid conduits extending into said multiple conduit structure and in fluid communication with said second fluid passage.

11. The drain system of claim 10, wherein:

said second sealing plug is insertable into said second fluid passage to inhibit flow through said second fluid passage and to prevent fluid communication between selected ones of said plurality of fluid conduits.

12. The drain system of claim 10, wherein:

each of said plurality of fluid conduits is connected in fluid communication with a cooling water reservoir of an internal combustion engine.

13. The drain system of claim 9, further comprising:

a third fluid passage formed through the body of said multiple conduit structure between said inboard and outboard ends; and a third sealing plug shaped to be received in said first fluid passage to prevent a fluid from passing therethrough.

14. The drain system of claim 13, wherein:

said third fluid passage is connected in fluid communication with an oil reservoir of an internal combustion engine.

15. A drain system for a marine vessel, comprising:

a multiple conduit structure shaped to be received through an opening formed in a transom of said marine vessel, said multiple conduit structure having an inboard end extending in a direction forward of said transom and an outboard end extending in a direction rearward of said transom;

a first fluid passage formed through the body of said multiple conduit structure between said inboard and outboard ends, said first fluid passage connecting a bilge region of said marine vessel in fluid communication with a region rearward of said transom;

a first sealing plug shaped to be received in said first fluid passage to prevent a fluid from passing therethrough, said first sealing plug being attachable in threaded relation with said first fluid passage at said outboard end of said multiple conduit structure;

a second fluid passage formed at least partially through the body of said multiple conduit structure between said inboard and outboard ends;

a second sealing plug shaped to be received in said second fluid passage to prevent a fluid from passing therethrough; and a plurality of fluid conduits extending into said multiple conduit structure and in fluid communication with said second fluid passage.

16. The drain system of claim 15, wherein:

said second sealing is insertable into said second fluid passage to inhibit flow through said second fluid passage and to prevent fluid communication between selected ones of said plurality of fluid conduits.

17. The drain system of claim 15, wherein:

each of said plurality of fluid conduits is connected in fluid communication with a cooling water reservoir of an internal combustion engine.

18. The drain system of claim 15, further comprising:

a third fluid passage formed through the body of said multiple conduit structure between said inboard and outboard ends; and a third sealing plug shaped to be received in said first fluid passage to prevent a fluid from passing therethrough.

19. The drain system of claim 18, wherein:

said third fluid passage is connected in fluid communication with an oil reservoir of an internal combustion engine.

* * * * *